US011782354B2

(12) United States Patent
Tsujihiro

(10) Patent No.: US 11,782,354 B2
(45) Date of Patent: Oct. 10, 2023

(54) TONER

(71) Applicant: KYOCERA Document Solutions Inc., Osaka (JP)

(72) Inventor: Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 269 days.

(21) Appl. No.: 17/329,800

(22) Filed: May 25, 2021

(65) Prior Publication Data

US 2021/0373449 A1 Dec. 2, 2021

(30) Foreign Application Priority Data

May 26, 2020 (JP) ..... 2020-091302

(51) Int. Cl.
*G03G 9/087* (2006.01)
*G03G 9/083* (2006.01)

(52) U.S. Cl.
CPC ..... *G03G 9/08755* (2013.01); *G03G 9/083* (2013.01); *G03G 9/08711* (2013.01); *G03G 9/08797* (2013.01)

(58) Field of Classification Search
CPC ..... G03G 9/08711; G03G 9/08755; G03G 9/08786
See application file for complete search history.

(56) References Cited

FOREIGN PATENT DOCUMENTS

JP 2008-287229 * 11/2008 ..... G03G 9/087
JP 2017-125916 A 7/2017

OTHER PUBLICATIONS

Translation of JP 2008-287229.*

* cited by examiner

*Primary Examiner* — Peter L Vajda
(74) *Attorney, Agent, or Firm* — Studebaker & Brackett PC

(57) ABSTRACT

A toner includes toner particles. The toner particles each include a toner mother particle containing a binder resin and a releasing agent. The binder resin includes a polyester resin and a vinyl resin. The vinyl resin includes a specific vinyl unit. A relationship $1.30 \leq Wabs/Wps \leq 2.00$ is satisfied where Wabs represents an absolute molecular weight at a largest peak on an absolute molecular weight distribution curve of the binder resin as measured by size-exclusion chromatography using a multi-angle laser light scattering detector, and Wps represents a relative molecular weight at a largest peak on a relative molecular weight distribution curve of the binder resin in terms of polystyrene as measured by size-exclusion chromatography using a differential refractive index detector.

8 Claims, No Drawings

TONER

INCORPORATION BY REFERENCE

The present application claims priority under 35 U.S.C. § 119 to Japanese Patent Application No. 2020-91302, filed on May 26, 2020. The contents of this application are incorporated herein by reference in their entirety.

BACKGROUND

The present disclosure relates to a toner.

Polyester resins are widely used as binder resins for the purpose of ensuring low-temperature fixability of toners.

SUMMARY

A toner according to an aspect of the present disclosure includes toner particles. The toner particles each include a toner mother particle containing a binder resin and a releasing agent. The binder resin includes a polyester resin and a vinyl resin. The vinyl resin includes one or more repeating units selected from the group consisting of a repeating unit derived from acrylic acid, a repeating unit derived from methacrylic acid, and a repeating unit represented by general formula (1) shown below. A relationship 1.30≤Wabs/Wps≤2.00 is satisfied where Wabs represents an absolute molecular weight at a largest peak on an absolute molecular weight distribution curve of the binder resin as measured by size-exclusion chromatography using a multi-angle laser light scattering detector, and Wps represents a relative molecular weight at a largest peak on a relative molecular weight distribution curve of the binder resin in terms of polystyrene as measured by size-exclusion chromatography using a differential refractive index detector.

(1)

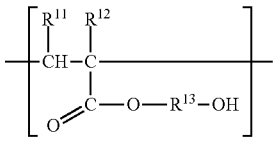

In general formula (1), $R^{11}$ and $R^{12}$ each represent, independently of one another, a hydrogen atom, a halogen atom, or an alkyl group having a carbon number of at least 1 and no greater than 6, and $R^{13}$ represents an alkylene group having a carbon number of at least 1 and no greater than 6.

DETAILED DESCRIPTION

The following describes a preferable embodiment of the present disclosure. Terms used in the present specification will be described first. A toner refers to an aggregate (e.g., a powder) of toner particles. An external additive refers to an aggregate (e.g., a powder) of external additive particles. A magnetic powder refers to an aggregate (e.g., a powder) of magnetic particles. Unless otherwise stated, evaluation results (e.g., values indicating shape and physical properties) for a powder (more specifically, a powder of toner particles or a powder of external additive particles) are each a number average of values measured with respect to an appropriate number of particles selected from the powder.

Measurement values for volume median diameter (D50) of particles (more specifically, a powder of particles) are each a median diameter in terms of volume as measured using a laser diffraction/scattering particle size distribution analyzer ("LA-950", product of HORIBA, Ltd.) unless otherwise stated. Values for number average primary particle diameter of a powder are each a number average value of equivalent circle diameters of 100 primary particles of the powder (Heywood diameters: diameters of circles having the same areas as projected areas of the respective primary particles) as measured using a scanning electron microscope ("JSM-7401F", product of JEOL Ltd.) and image analysis software ("WinROOF", product of MITANI CORPORATION). Note that the number average primary particle diameter of particles refers to a number average primary particle diameter of the particles of a powder (number average primary particle diameter of the powder) unless otherwise stated.

Chargeability refers to ease of triboelectric charging unless otherwise stated. For example, a measurement target (e.g., a toner) is triboelectrically charged by mixing and stirring the measurement target and a standard carrier (standard carrier for negatively chargeable toner: N-01, standard carrier for positively chargeable toner: P-01) provided by the Imaging Society of Japan. The charge amount of the measurement target is measured before and after triboelectric charging using for example a suction type compact charge measurement device ("MODEL 212HS", product of TREK, INC.). The measurement target with a larger change in the charge amount before and after triboelectric charging indicates higher chargeability.

Measurement values for softening point (Tm) are values as measured using a capillary rheometer ("CFT-500D", product of Shimadzu Corporation) unless otherwise stated. On an S-shaped curve (vertical axis: temperature, horizontal axis: stroke) plotted using the capillary rheometer, the softening point (Tm) is a temperature corresponding to a value of "(base line stroke value+maximum stroke value)/2". Unless otherwise stated, measurement values for glass transition point (Tg) are values as measured in accordance with "Japanese Industrial Standards (JIS) K7121-2012" using a differential scanning calorimeter ("DSC-6220", product of Seiko Instruments Inc.). On a heat absorption curve (vertical axis: heat flow (DSC signals), horizontal axis: temperature) plotted using the differential scanning calorimeter, the glass transition point (Tg) is a temperature corresponding to a value at a point of variation due to grass transition (specifically, a temperature at an intersection point of an extrapolation of the base line and an extrapolation of the inclined portion of the curve).

Measurement values for acid value and hydroxyl value are values as measured in accordance with the neutralization titration method defined in "Japanese Industrial Standards (JIS) K0070-1992" unless otherwise stated.

Measurement values for number average molecular weight (Mn) and mass average molecular weight (Mw) are values as measured by gel permeation chromatography unless otherwise stated.

An "alkyl group having a carbon number of at least 1 and no greater than 6" is an unsubstituted straight chain or branched chain alkyl group. Examples of the alkyl group having a carbon number of at least 1 and no greater than 6 include a methyl group, an ethyl group, an n-propyl group, an isopropyl group, an n-butyl group, an s-butyl group, a t-butyl group, an n-pentyl group, an isopentyl group, a neopentyl group, and an n-hexyl group.

An "alkylene group having a carbon number of at least 1 and no greater than 6 is an unsubstituted straight chain or branched chain alkylene group. Examples of the alkylene group having a carbon number of at least 1 and no greater than 6 include a methylene group, an ethylene group, an n-propylene group, an isopropylene group, an n-butylene group, an n-pentylene group, and an n-hexylene group.

In the present specification, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. A "vinyl resin" is a polymer of a monomer (vinyl compound) having a vinyl group ($CH_2$=CH—) or a group in which a hydrogen atom in the vinyl group is replaced.

<Toner>

A toner according to the present embodiment can be favorably used for example as a positively chargeable toner for electrostatic latent image development. The toner may be used as a one-component developer. Alternatively, a two-component developer may be prepared by mixing the toner and a carrier using a mixer (for example, a ball mill).

The toner particles included in the toner of the present embodiment each include a toner mother particle containing a binder resin and a releasing agent. The binder resin includes a polyester resin and a vinyl resin. The vinyl resin includes one or more repeating units selected from the group consisting of a repeating unit derived from acrylic acid, a repeating unit derived from methacrylic acid, and a repeating unit represented by general formula (1) shown below. A relationship 1.30≤Wabs/Wps≤2.00 is satisfied where Wabs represents an absolute molecular weight at a largest peak on an absolute molecular weight distribution curve of the binder resin as measured by size-exclusion chromatography using a multi-angle laser light scattering detector, and Wps represents a relative molecular weight at a largest peak on a relative molecular weight distribution curve of the binder resin in terms of polystyrene as measured by size-exclusion chromatography using a differential refractive index detector.

(1)

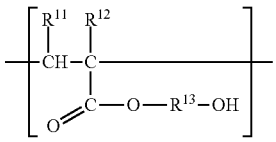

In general formula (1), $R^{11}$ and $R^{12}$ each represent, independently of one another, a hydrogen atom, a halogen atom, or an alkyl group having a carbon number of at least 1 and no greater than 6, and $R^{13}$ represents an alkylene group having a carbon number of at least 1 and no greater than 6.

In the following, the repeating unit represented by general formula (1) may be referred to as "repeating unit (1)". A monomer that gives the repeating unit (1) may be referred to as "compound (1)". One or more compounds selected from the group consisting of acrylic acid, methacrylic acid, and the compound (1) may each be referred to as "specific vinyl compound". A repeating unit derived from the specific vinyl compound may referred to as "specific vinyl unit".

In the following, size-exclusion chromatography using a multi-angle laser light scattering detector may be referred to as "SEC-MALLS method". Also, size-exclusion chromatography using a differential refractive index detector may be referred to as "SEC-RI method". The absolute molecular weight at a largest peak on an absolute molecular weight distribution curve of the binder resin as measured by the SEC-MALLS method may be referred to as "Wabs". A relative molecular weight in terms of polystyrene may be referred to simply as "relative molecular weight". The relative molecular weight at a largest peak on a relative molecular weight distribution curve of the binder resin as measured by the SEC-RI method may be referred to as "Wps". Methods for measuring Wabs and Wps are methods described in association with Example described later or methods conforming thereto. Note that as shown in Examples described later, Wabs and Wps each are a value as measured for a binder resin as a measurement target dissolved in tetrahydrofuran at a temperature of 25° C. Typically, the molecular radius of a polymer or a resin (specifically, molecular radius of polymer present in polymer solution) increases as the molecular weight thereof is increased. In the SEC-RI method, a relative molecular weight of the target polymer is obtained that has the same molecular radius as the polystyrene used in plotting a calibration curve. However, a polymer with relatively more of either or both branching points and cross-linking points (also referred to below as "branching and cross-linking points") has a smaller molecular radius than polymers with relatively fewer branching and cross-linking points if there is no difference in molecular weight therebetween. Therefore, when the relative molecular weight of a polymer with relatively many branching and cross-linking points is measured by the SEC-RI method, the obtained relative molecular weight will be smaller than the actual molecular weight.

On the other hand, when measuring the absolute molecular weight by the SEC-MALLS method, if there is no difference in molecular weight between a polymer with a relatively many branching and cross-linking points and a polymer with relatively few branching and cross-linking points, the absolute molecular weight will be the same therebetween.

Therefore, the ratio of Wabs to Wps (Wabs/Wps) is an indicator of the number of branching and cross-linking points. In other words, the larger the Wabs/Wps is, the greater the number of branching and cross-linking points in a polymer being a measurement target.

As a result of the toner of the present embodiment having the above features, images with excellent fixing strength can be formed while ensuring low-temperature fixability, and the toner can have excellent hot offset resistance. Presumably, the reason for the above is as follows.

Typically, a toner containing a polyester resin as a binder resin has excellent low-temperature fixability. However, a polyester resin typically used as a binder resin has low compatibility with a releasing agent that is a component for increasing hot offset resistance of a toner.

By contrast, a vinyl resin is typically inferior to a polyester resin in a function to increase low-temperature fixability, but has a high compatibility with a releasing agent. Although it can be contemplated to use a polyester resin and a vinyl resin in combination as a binder resin in order to increase low-temperature fixability of a toner and compatibility between the binder resin and a releasing agent, typical vinyl resins have low compatibility with polyester resins.

The binder resin contained in the toner according to the present embodiment includes a polyester resin and a vinyl resin having the specific vinyl unit. The specific vinyl unit in the vinyl resin has high affinity with a polyester resin.

Therefore, in the toner according to the present embodiment, the polyester resin and the vinyl resin are moderately compatible with each other and the binder resin and the releasing agent are moderately compatible with each other. Furthermore, the toner according to the present embodiment has a Wabs/Wps of at least 1.30, which means that the number of branching and cross-linking points of the binder resin is relatively large. In a toner containing a binder resin with a relatively large number of branching and cross-linking points, the toner particles tend to have high elasticity. Therefore, the toner according to the present embodiment can have excellent hot offset resistance and images with excellent fixing strength can be formed with the toner.

Furthermore, typically, when the number of branching and cross-linking points in a binder resin is excessively large (when elasticity of toner particles is excessively high), low-temperature fixability of the toner tends to decrease. In view of the foregoing, the toner according to the present embodiment has a Wabs/Wps of no greater than 2.00. As such, the upper limit of the Wabs/Wps is set to the extent that low-temperature fixability of the toner can be ensured in the toner according to the present embodiment. Therefore, the toner according to the present embodiment can ensure low-temperature fixability.

In order that images with further excellent fixing strength can be formed while further easily ensuring low-temperature fixability and in order for the toner to have further excellent hot offset resistance, the value of Wabs/Wps is preferably at least 1.62 and no greater than 1.67, more preferably at least 1.63 and no greater than 1.66.

The toner particles included in the toner according to the present embodiment may further contain an external additive. When the toner particles further contain an external additive, the toner particles each include a toner mother particle and the external additive attached to the surface of the toner mother particle. Note that the external additive may be omitted if it is not necessary. In the case where the external additive is omitted, the toner mother particle is equivalent to the toner particle.

The toner particles included in the toner according to the present embodiment may be toner particles with no shell layers or toner particles with shell layers (also referred to below as capsule toner particles). In each capsule toner particle, the toner mother particle includes a toner core containing the binder resin and the releasing agent and a shell layer covering the surface of the toner core. The shell layer contains a resin. For example, the toner can have both heat-resistant preservability and low-temperature fixability by using low-melting-temperature toner cores and covering each toner core with a highly heat-resistant shell layer. An additive may be dispersed in the resin constituting the shell layer. The shell layer may cover the entire surface of the toner core or partially cover the surface of the toner core.

In the present embodiment, the toner mother particles may further contain, in addition to the binding resin and the releasing agent, an internal additive other than the releasing agent (e.g., at least one of a colorant, a charge control agent, and a magnetic powder), if necessary.

In order for the toner to be suitable for image formation, the toner mother particles preferably have a volume median diameter (D50) of at least 4 μm and no greater than 9 μm in the present embodiment.

Components contained in the toner according to the present embodiment (more specifically, the toner particles) will be described next.

[Binder Resin]

For example, the binder resin accounts for at least 40% by mass of all the components of the toner mother particles. Accordingly, properties of the binder resin are thought to have a great influence on overall properties of the toner mother particles. The binder resin includes a polyester resin and a vinyl resin. Alternatively, the binder resin may include a resin in addition to the polyester resin and the vinyl resin. In order that images with excellent fixing strength can be formed while further easily ensuring low-temperature fixability and in order for the toner to have excellent hot offset resistance, the total content ratio of the polyester resin and the vinyl resin in the toner mother particles to the total amount of the binder resin is preferably at least 90% by mass and no greater than 100% by mass, and particularly preferably 100% by mass.

The polyester resin and the vinyl resin included as the binding resin in the toner mother particles will be described below.

(Polyester Resin)

The polyester resin is obtained by condensation polymerization of one or more polyhydric alcohol compounds and one or more polybasic carboxylic acids. Examples of a polyhydric alcohol compound for synthesis of the polyester resin include dihydric alcohol compounds (specific examples include aliphatic diols and bisphenols) and tri- or higher-hydric alcohol compounds listed below. Examples of a polybasic carboxylic acid for synthesis of the polyester resin include dibasic carboxylic acids and tri- or higher-basic carboxylic acids listed below. Note that a polybasic carboxylic acid derivative that can form an ester bond through condensation polymerization (specific examples include anhydrides of polybasic carboxylic acids and halides of polybasic carboxylic acids) may be used instead of the polybasic carboxylic acid.

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohol compounds include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, 1,10-decanedicarboxylic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Preferable examples of the tri- or higher-basic carboxylic acids include trimellitic acid (1,2,4-benzenetricarboxylic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

In order to easily adjust the value of Wabs/Wps within a range of at least 1.30 and no greater than 2.00, the polyester resin preferably includes at least one repeating unit selected from the group consisting of repeating units derived from tri- or higher-hydric alcohol compounds and repeating units derived from tri- or higher-basic carboxylic acids (also referred to below as specific poly-repeating unit). A polyester resin including a repeating unit derived from a tri- or higher-hydric alcohol compound is obtained for example by condensation polymerization of a monomer including one or more selected from the group consisting of the tri- or higher-hydric alcohol compounds listed above. A polyester resin including a repeating unit derived from a tri- or higher-basic carboxylic acid is obtained for example by condensation polymerization of a monomer including one or more selected from the group consisting of the tri- or higher-basic carboxylic acids listed above. When a monomer including one or more selected from the group consisting of the tri- or higher-hydric alcohol compounds and the tri- or higher-basic carboxylic acids is used as a monomer for synthesis of the polyester resin, the resultant polyester resin can have an increased number of branching points.

In order for images with excellent fixing strength to be able be formed and in order for the toner to have excellent hot offset resistance, the polyester resin preferably includes as the specific poly-repeating unit a repeating unit derived from glycerol or a repeating unit derived from trimellitic acid.

(Vinyl Resin) The vinyl resin includes a repeating unit (specific vinyl unit) derived from one or more compounds selected from the group consisting of acrylic acid, methacrylic acid, and the compound (1). In order to easily adjust the value of Wabs/Wps within a range of at least 1.30 and no greater than 2.00, the content ratio of the specific vinyl unit to all repeating units included in the vinyl resin is preferably at least 8% by mass and no greater than 18% by mass.

In general formula (1) representing the compound (1), it is preferable that $R^{11}$ and $R^{12}$ each represent, independently of one another, a hydrogen atom or a methyl group. Preferably, $R^{13}$ represents an ethylene group.

Examples of the compound (1) include 2-hydroxyethyl (meth)acrylate, 3-hydroxypropyl (meth)acrylate, 2-hydroxypropyl (meth)acrylate, and 4-hydroxybutyl (meth) acrylate.

In order for images with excellent fixing strength to be able to be formed and in order for the toner to have excellent hot offset resistance, a repeating unit derived from 2-hydroxyethyl methacrylate is preferable as the repeating unit represented by general formula (1) (repeating unit (1)).

Any specific vinyl compounds that give a specific vinyl unit have a functional group that reacts with a monomer for synthesis of the polyester resin (also referred to below as condensation reaction group). In detail, both acrylic acid and methacrylic acid include a carboxy group as a condensation reaction group. Furthermore, the compound (1) has an alcoholic hydroxyl group as a condensation reaction group. Accordingly, when a monomer including a specific vinyl compound is polymerized in presence of a polyester resin, the polyester resin and the vinyl resin are crosslinked through at least some of the specific vinyl units. Therefore, polymerization of the monomer including the specific vinyl compound in presence of the polyester resin can increase the number of cross-linking points of the binder resin. In the following, a resin obtainable by polymerization of a monomer including a specific vinyl compound in presence of a polyester resin may be also referred to below as "composite resin". In the composite resin, the polyester resin (polyester resin domain) and the vinyl resin (vinyl resin domain) are mixed.

In order for images with excellent fixing strength to be able to be formed and in order for the toner to have excellent hot offset resistance, it is preferable that the vinyl resin further includes one or more repeating units selected from the group consisting of a repeating unit derived from styrene, a repeating unit derived from acrylonitril, and a repeating unit represented by general formula (2) below.

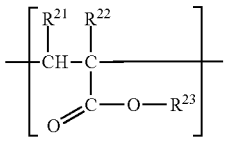

(2)

In general formula (2), $R^{21}$ and $R^{22}$ each represent, independently of one another, a hydrogen atom, a halogen atom, or an alkyl group having a carbon number of at least 1 and no greater than 6, and $R^{23}$ represents an alkyl group having a carbon number of at least 1 and no greater than 6. Preferably, $R^{21}$ and $R^{22}$ each represent, independently of one another, a hydrogen atom or a methyl group. Preferably, $R^{23}$ represents a methyl group. In the following, the repeating unit represented by general formula (2) may be also referred to below as "repeating unit (2)".

Examples of a monomer that gives the repeating unit (2) include methyl (meth)acrylate, ethyl (meth)acrylate, n-propyl (meth)acrylate, iso-propyl (meth)acrylate, n-butyl (meth)acrylate, and isobutyl (meth)acrylate.

In order for images with excellent fixing strength to be able to be formed and in order for the toner to have excellent hot offset resistance, a repeating unit derived from methyl methacrylate is preferable as the repeating unit (2).

In order for images with further excellent fixing strength to be able to be formed while further easily ensuring low-temperature fixability and in order for the toner to have further excellent hot offset resistance, the amount of the vinyl resin is preferably at least 5 parts by mass and no greater than 15 parts by mass relative to 100 parts by mass of the polyester resin, and more preferably at least 9 parts by mass and no greater than 12 parts by mass. Note that when a composite resin is used as the binder resin, the specific vinyl unit is counted as a repeating unit in the vinyl resin in calculation of the amount of the vinyl resin relative to 100 parts by mass of the polyester resin.

The value of Wabs/Wps can be adjusted for example by changing at least one of: reaction conditions (specific examples include reaction time and reaction temperature) for synthesis of the binder resin (specifically, at least one of the polyester resin and the vinyl resin); the amount of a tri- or higher-hydric alcohol compound in synthesis of the polyester resin; the amount of a tri- or higher-basic carboxylic acid in synthesis of the polyester resin; and the amount of the specific vinyl compound in synthesis of the vinyl resin.

In order for images with further excellent fixing strength to be able to be formed while further easily ensuring low-temperature fixability and in order for the toner to have further excellent hot offset resistance, it is preferable to satisfy the following condition 1 and it is more preferable to satisfy the following condition 2.

Condition 1: The polyester resin includes a specific poly-repeating unit and the value of Wabs/Wps is at least 1.63 and no greater than 1.66.

Condition 2: Condition 1 is satisfied and the amount of the specific poly-repeating unit is at least 10 parts by mass and no greater than 70 parts by mass relative to 100 parts by mass of the specific vinyl unit.

[Releasing Agent]

The toner mother particles contain a releasing agent. The amount of the releasing agent is preferably at least 1 part by mass and no greater than 10 parts by mass relative to 100 parts by mass of the binder resin in order for the toner to have further excellent hot offset resistance.

Examples of the releasing agent include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of the ester waxes include natural ester waxes (specific examples include carnauba wax and rice wax) and synthetic ester wax. One releasing agent may be used independently or two or more releasing agents may be used in combination in the present embodiment. The releasing agent is preferably carnauba wax in order for the toner to have further excellent hot offset resistance.

A compatibilizer may be added to the toner mother particles in order to improve compatibility between the binder resin and the releasing agent.

[Colorant]

The toner mother particles may contain a colorant. A known pigment or dye matching a color of the toner can be used as a colorant. In order for the toner to be suitable for formation of high-quality images, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may contain a non-black colorant. Examples of the non-black colorant include yellow colorants, magenta colorants, and cyan colorants.

One or more compounds selected from the group consisting of condensed azo compounds, isoindolinone compounds, anthraquinone compounds, azo metal complexes, methine compounds, and arylamide compounds can be used as a yellow colorant.

Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as a magenta colorant. Specific examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

One or more compounds selected from the group consisting of copper phthalocyanine compounds, anthraquinone compounds, and basic dye lake compounds can be used as a cyan colorant. Specific examples of the cyan colorant include C.I. Pigment Blue (1, 7, 15, 15:1, 15:2, 15:3, 15:4, 60, 62, or 66), Phthalocyanine Blue, C.I. Vat Blue, and C.I. Acid Blue.

[Charge Control Agent]

The toner mother particles may contain a charge control agent. The charge control agent is used for the purpose of imparting excellent charge stability or an excellent charge rise characteristic to the toner, for example. The charge rise characteristic of the toner is an indicator as to whether or not the toner can be charged to a specific charging level in a short period of time.

When the toner mother particles contain a positively chargeable charge control agent, cationic strength (positive chargeability) of the toner mother particles can be increased. When the toner mother particles contain a negatively chargeable charge control agent by contrast, anionic strength (negative chargeability) of the toner mother particles can be increased.

Examples of the positively chargeable charge control agent include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acidic dyes such as Nigrosin BK, Nigrosin NB, and Nigrosin Z; alkoxylated amines; alkylamides; quaternary ammonium salts such as benzyl decylhexylmethylammonium chloride, decyltrimethylammonium chloride, 2-(methacryloyloxy)ethyl trimethylammonium chloride, and dimethylaminopropylacrylamide methyl chloride quaternary salt; and resins having a quaternary ammonium cationic group. One of the charge control agents listed above may be used independently or two or more of the charge control agents listed above may be used in combination.

Examples of the negatively chargeable charge control agent include an organic metal complex that is a chelate compound. One or more selected from the group consisting of metal acetylacetonate complexes, salicylic acid-based metal complexes, and salts of these are preferable as the organic metal complex.

The amount of the charge control agent is preferably at least 0.1 parts by mass and no greater than 20 parts by mass relative to 100 parts by mass of the binder resin in order for the toner to have excellent charge stability.

[Magnetic Powder]

The toner mother particles may contain a magnetic powder. That is, the toner according to the present embodiment may be a toner (magnetic toner) including toner mother particles containing a magnetic powder. When the toner mother particles contain a magnetic powder, images with excellent fixing strength can be formed while ensuring low-temperature fixability and a toner with excellent hot offset resistance can be easily obtained. Note that the toner mother particles may contain a magnetic powder as a black colorant. That is, the magnetic powder may function as both a magnetic material and a black colorant.

Examples of a material of the magnetic powder include ferromagnetic metals (specific examples include iron, cobalt, and nickel), alloys thereof, oxides of ferromagnetic metals (specific examples include ferrite, magnetite, and chromium dioxide), and materials subjected to ferromagnetization (specific examples include carbon materials rendered ferromagnetic through thermal treatment). One magnetic powder may be used independently or two or more magnetic powders may be used in combination in the present embodiment.

In order to form high-quality images (e.g., images with high image density), the amount of the magnetic powder is preferably at least 60 parts by mass and no greater than 120 parts by mass relative to 100 parts by mass of the binder resin, and more preferably at least 70 parts by mass and no greater than 110 parts by mass.

[External Additive]

The toner particles included in the toner according to the present embodiment may further contain an external additive (powder of external additive particles) attached to the surfaces of the toner mother particles. One type of external additive particles may be used independently or two or more types of external additive particles may be used in combination in the present embodiment.

In order for the toner to have excellent fluidity, the external additive particles constituting the external additive are preferably inorganic oxide particles, and more preferably one or more types selected from the group consisting of silica particles and particles of metal oxides (specific examples include alumina, titanium oxide, magnesium oxide, zinc oxide, strontium titanate, and barium titanate).

The external additive particles constituting the external additive preferably have a number average primary particle diameter of at least 5 nm and no greater than 50 nm in order for the toner to have excellent fluidity.

The external additive particles may be surface-treated. For example, in a case in which silica particles are used as the external additive particles, either or both hydrophobicity and positive chargeability may be imparted to the surfaces of the silica particles with a surface treatment agent. Examples of the surface treatment agent include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oil). One or more selected from the group consisting of the silane coupling agents and the silazane compounds are particularly preferable as the surface treatment agent. Preferable examples of the silane coupling agents include silane compounds (specific examples include methyltrimethoxysilane and aminosilane). Preferable examples of the silazane compounds include hexamethyldisilazane (HMDS). When the surface of a silica base (untreated silica particles) is treated with a surface treatment agent, a large number of hydroxyl groups (—OH) present on the surface of the silica base are partially or fully replaced with functional groups derived from the surface treatment agent. As a result, silica particles are obtained which have on the surfaces thereof the functional groups derived from the surface treatment agent (specifically, functional groups that are more hydrophobic and/or more positively chargeable than the hydroxyl groups).

The amount of the external additive is preferably at least 0.1 parts by mass and no greater than 10.0 parts by mass relative to 100 parts by mass of the toner mother particles in order that the external additive sufficiently exhibits its function while inhibiting detachment of the external additive from the toner mother particles.

<Toner Production Method>

The following describes a preferable production method of the above-described toner according to the present embodiment. In the following, description of constituent elements overlapping with those of the above-described toner according to the present embodiment is omitted.

[Toner Mother Particle Preparation]

First, the toner mother particles are prepared by an aggregation method or a pulverization method.

The aggregation method involves for example an aggregation process and a coalescence process. In the aggregation process, fine particles containing the components constituting the toner mother particles are caused to aggregate in an aqueous medium to form aggregated particles. In the coalescence process, the components contained in the aggregated particles are allowed to coalesce in the aqueous medium to form the toner mother particles.

The following describes the pulverization method. By the pulverization method, the toner mother particles can be relatively easily prepared and production cost can be reduced. Toner mother particle preparation by the pulverization method involves for example a melt-kneading process and a pulverization process. The toner mother particle preparation may further involve a mixing process before the melt-kneading process. Also, the toner mother particle preparation may further involve at least one of a fine pulverization process and a classification process after the pulverization process.

In the mixing process, a mixture is obtained by mixing the binder resin, the releasing agent, and the internal additive optionally added as necessary. In the melt-kneading process, a melt-kneaded product is obtained by melting and kneading toner materials. The mixture obtained in the mixing process is used as the toner material, for example. In the pulverization process, the resultant melt-kneaded product is cooled to for example room temperature (25° C.) and then pulverized to obtain a pulverized product. When it is necessary to reduce the diameter of the pulverized product obtained in the pulverization process, a process of further pulverizing the pulverized product (fine pulverization process) may be performed. In addition, in order to equalize the particle diameter of the pulverized product, a process of classifying the resultant pulverized product (classification process) may be performed. Note that the melt-kneaded product may be classified while being pulverized in the pulverization process. Through the above processes, toner mother particles being a pulverized product are obtained.

[External Additive Addition]

Thereafter, as necessary, the obtained toner mother particles and an external additive may be mixed using a mixer (e.g., an FM mixer produced by Nippon Coke & Engineering Co., Ltd.) to attach the external additive to the surfaces of the toner mother particles. Note that the toner mother particles may be used as the toner particles without attaching the external additive to the toner mother particles. Through the above, the toner (powder of the toner particles) according to the present embodiment is obtained.

EXAMPLES

Examples of the present disclosure will be described below. However, the present disclosure is not limited to the scope of Examples.

<Synthesis of Binder Resin>

Respective methods for synthesizing composite resins C-1 to C-19 and a polyester resin P-1 that were each used as a binder resin will be described below.

[Synthesis of Composite Resin C-1] A four-necked flask equipped with a thermometer (thermocouple), a dewatering conduit, a nitrogen inlet tube, and a stirrer was set in a heating mantle. Subsequently, the flask was charged with 1245 g of terephthalic acid, 1245 g of isophthalic acid, 1245 g of bisphenol A ethylene oxide adduct (average number of moles added of ethylene oxide: 2 mol), and 744 g of ethylene glycol. Next, the internal atmosphere of the flask was changed to a nitrogen atmosphere, and then the flask was heated while the flask contents were stirred until the internal temperature of the flask became 250° C. Subsequently, 0.875 g of antimony trioxide, 0.548 g of triphenyl phosphate, and 0.102 g of tetra-n-butyl titanate were added into the flask. Next, the internal pressure of the flask was reduced to 8 kPa and the internal temperature of the flask was increased to 280° C. Then, the flask contents were allowed to react for 6 hours under a condition of a temperature of 280° C. Then, the internal pressure of the flask was returned to the standard pressure (101 kPa) and the internal temperature of the flask was reduced to 160° C. Thereafter, 20 g of trimellitic acid, 75 g of acrylic acid, 500 g of styrene, and 30 g of dicumyl peroxide were added into the flask. Next, the flask contents were allowed to react for 1 hour under a condition of a temperature of 160° C. and then cooled, thereby obtaining a composite resin C-1.

[Synthesis of Composite Resins C-2 to C-9]

Composite resins C-2 to C-9 were synthesized according to the same method as that for synthesis of the composite resin C-1 in all aspects other than that the respective amounts of use (amount of charge) of terephthalic acid, isophthalic acid, bisphenol A ethylene oxide adduct (average number of moles added of ethylene oxide: 2 mol), ethylene glycol, trimellitic acid, and acrylic acid were changed to those shown in Tables 1 to 3 and the reaction temperature and the reaction time in the reaction under the condition of a pressure of 8 kPa were changed to those shown in Tables 1 and 3. Note that "BPAEO adduct" in Tables 1 to 3 refers to bisphenol A ethylene oxide adduct (average number of moles added of ethylene oxide: 2 mol). Also, "Reaction temperature" and "Reaction time" in Tables 1 to 3 respectively refer to reaction temperature and reaction time in the reaction under the condition of a pressure of 8 kPa.

TABLE 1

| | Composite resin C-1 | Composite resin C-2 | Composite resin C-3 |
|---|---|---|---|
| Amount of use of terephthalic acid [g] | 1245 | 1245 | 1245 |
| Amount of use of isophthalic acid [g] | 1245 | 1245 | 1245 |
| Amount of use of BPAEO adduct [g] | 1245 | 1245 | 1245 |
| Amount of use of ethylene glycol [g] | 744 | 744 | 744 |
| Amount of use of trimellitic acid [g] | 20 | 20 | 20 |
| Amount of use of acrylic acid [g] | 75 | 75 | 75 |
| Reaction temperature [° C.] | 280 | 250 | 300 |
| Reaction time [hour (h)] | 6.0 | 10.0 | 4.0 |

TABLE 2

| | Composite resin C-4 | Composite resin C-5 | Composite resin C-6 |
|---|---|---|---|
| Amount of use of terephthalic acid [g] | 2000 | 1245 | 1245 |
| Amount of use of isophthalic acid [g] | 490 | 1245 | 1245 |

TABLE 2-continued

| | Composite resin C-4 | Composite resin C-5 | Composite resin C-6 |
|---|---|---|---|
| Amount of use of BPAEO adduct [g] | 1245 | 715 | 1245 |
| Amount of use of ethylene glycol [g] | 744 | 850 | 744 |
| Amount of use of trimellitic acid [g] | 20 | 20 | 45 |
| Amount of use of acrylic acid [g] | 75 | 75 | 75 |
| Reaction temperature [° C.] | 280 | 280 | 280 |
| Reaction time [hour (h)] | 5.5 | 6.5 | 4.0 |

TABLE 3

| | Composite resin C-7 | Composite resin C-8 | Composite resin C-9 |
|---|---|---|---|
| Amount of use of terephthalic acid [g] | 1245 | 1245 | 1245 |
| Amount of use of isophthalic acid [g] | 1245 | 1245 | 1245 |
| Amount of use of BPAEO adduct [g] | 1245 | 1245 | 1245 |
| Amount of use of ethylene glycol [g] | 744 | 744 | 744 |
| Amount of use of trimellitic acid [g] | 11 | 20 | 20 |
| Amount of use of acrylic acid [g] | 75 | 100 | 50 |
| Reaction temperature [° C.] | 280 | 280 | 280 |
| Reaction time [hour (h)] | 8.0 | 6.0 | 6.0 |

[Synthesis of Composite Resin C-10]

A four-necked flask equipped with a thermometer (thermocouple), a dewatering conduit, a nitrogen inlet tube, and a stirrer was set in a heating mantle. Subsequently, the flask was charged with 1245 g of sebacic acid, 1245 g of 1,10-decanedicarboxylic acid, 1248 g of 1,4-butanediol, and 744 g of 1,6-hexanediol. Next, the internal atmosphere of the flask was changed to a nitrogen atmosphere, and then the flask was heated while the flask contents were stirred until the internal temperature of the flask became 250° C. Subsequently, 0.639 g of titanium (IV) methoxide, 0.452 g of bis(2-ethylhexyl) hydrogen phosphate, and 0.205 g of triphenyl phosphate were added into the flask. Next, the internal pressure of the flask was reduced to 8 kPa and the internal temperature of the flask was increased to 280° C. Then, the flask contents were allowed to react for 6 hours under a condition of a temperature of 280° C. Then, the internal pressure of the flask was returned to the standard pressure (101 kPa) and the internal temperature of the flask was reduced to 160° C. Thereafter, 20 g of trimellitic acid, 75 g of acrylic acid, 500 g of styrene, and 30 g of dicumyl peroxide were added into the flask. Next, the flask contents were allowed to react for 1 hour under a condition of a temperature of 160° C. and then cooled, thereby obtaining a composite resin C-10.

[Synthesis of Composite Resin C-11]

A four-necked flask equipped with a thermometer (thermocouple), a dewatering conduit, a nitrogen inlet tube, and a stirrer was set in a heating mantle. Subsequently, the flask was charged with 1245 g of adipic acid, 1245 g of fumaric acid, 1248 g of bisphenol A propylene oxide adduct (average number of moles added to propylene oxide: 2 mol), and 744 g of 1,6-hexanediol. Next, the internal atmosphere of the flask was changed to a nitrogen atmosphere, and then the flask was heated while the flask contents were stirred until the internal temperature of the flask reached 250° C. Subsequently, 0.639 g of germanium oxide (IV), 0.452 g of dibutyl phosphate, and 0.205 g of bis(2-ethylhexyl) hydrogen phosphate were added into the flask. Next, the internal pressure of the flask was reduced to 8 kPa and the internal temperature of the flask was increased to 280° C. Then, the flask contents were allowed to react for 6 hours under a condition of a temperature of 280° C. Then, the internal pressure of the flask was returned to the standard pressure (101 kPa) and the internal temperature of the flask was reduced to 160° C. Thereafter, 20 g of trimellitic acid, 75 g of acrylic acid, 400 g of styrene, and 30 g of dicumyl peroxide were added into the flask. Next, the flask contents were allowed to react for 1 hour under a condition of a temperature of 160° C. and then cooled, thereby obtaining a composite resin C-11.

[Synthesis of Composite Resin C12]

A composite resin C-12 was obtained according to the same method as that for synthesis of the composite resin C-1 in all aspects other than that 70 g of methacrylic acid was used (charged) instead of 75 g of acrylic acid.

[Synthesis of Composite Resin C-13]

A composite resin C-13 was obtained according to the same method as that for synthesis of the composite resin C-1 in all aspects other than that the amount of use (amount of charge) of trimellitic acid was changed to 35 g and 70 g of 2-hydroxyethyl methacrylate was used (charged) instead of 75 g of acrylic acid.

[Synthesis of Composite Resin C-14]

A composite resin C-14 was obtained according to the same method as that for synthesis of the composite resin C-1 in all aspects other than that 9 g of glycerol was used (charged) instead of 20 g of trimellitic acid and 70 g of methacrylic acid was used (charged) instead of 75 g of acrylic acid.

[Synthesis of Composite Resin C-15]

A composite resin C-15 was obtained according to the same method as that for synthesis of the composite resin C-1 in all aspects other than that the amount of use (amount of charge) of trimellitic acid was changed to 30 g and 500 g of methyl methacrylate was used (charged) instead of 500 g of styrene.

[Synthesis of Composite Resin C-16]

A composite resin C-16 was obtained according to the same method as that for synthesis of the composite resin C-1 in all aspects other than that the amount of use (amount of charge) of trimellitic acid was changed to 30 g and 500 g of acrylonitrile was used (charged) instead of 500 g of styrene.

[Synthesis of Composite Resin C-17]

A composite resin C-17 was obtained according to the same method as that for synthesis of the composite resin C-1 in all aspects other than that the amount of use (amount of charge) of trimellitic acid was changed to 50 g, styrene was not used (charged), and the reaction time in the reaction under the condition of a pressure of 8 kPa was changed to 3.0 hours.

[Synthesis of Composite Resin C-18]

A composite resin C-18 was obtained according to the same method as that for synthesis of the composite resin C-1 in all aspects other than that the amount of use (amount of charge) of trimellitic acid was changed to 5 g and the reaction time in the reaction under the condition of a pressure of 8 kPa was changed to 10.0 hours.

[Synthesis of Composite Resin C-19]

A composite resin C-19 was obtained according to the same method as that for synthesis of the composite resin C-1 in all aspects other than that acrylic acid was not used (charged).

[Synthesis of Polyester Resin P-1]

A polyester resin P-1 was obtained according to the same method as that for synthesis of the composite resin C-1 in all aspects other than that acrylic acid, styrene, and dicumyl peroxide were not used (charged).

Tables 4 to 7 show the amount of the vinyl resin relative to 100 parts by mass of the polyester resin, Tg, Tm, Mn, Mw, Mw/Mn, acid value, and hydroxyl value for each of the composite resins C-1 to C-19 and the polyester resin P-1 thus obtained. Note that "Vinyl resin amount" in Tables 4 to 7 refers to an amount (unit: part by mass) of the vinyl resin relative to 100 parts by mass of the polyester resin. Also, "-" in the row titled "Vinyl resin amount" in Table 7 refers to polymerization of the vinyl compound not being performed. Note that the amount of the specific poly-repeating unit was at least 10 parts by mass and no greater than 70 parts by mass relative to 100 parts by mass of the specific vinyl unit in each of the composite resins C-1 to C-16.

TABLE 4

| | Composite resin C-1 | Composite resin C-2 | Composite resin C-3 | Composite resin C-4 | Composite resin C-5 |
|---|---|---|---|---|---|
| Vinyl resin amount [part by mass] | 11 | 11 | 11 | 11 | 12 |
| Tg [° C.] | 58.6 | 58.7 | 59.2 | 60.2 | 57.2 |
| Tm [° C.] | 100.8 | 101.2 | 103.8 | 102.3 | 100.4 |
| Mn | 1327 | 1360 | 1390 | 1436 | 1420 |
| Mw | 14100 | 13650 | 13620 | 14360 | 14520 |
| Mw/Mn | 10.6 | 10.0 | 9.8 | 10.0 | 10.2 |
| Acid value [mgKOH/g] | 8.4 | 8.3 | 8.1 | 8.3 | 8.3 |
| Hydroxyl value [mgKOH/g] | 22.2 | 20.4 | 23.2 | 20.8 | 23.2 |

TABLE 5

| | Composite resin C-6 | Composite resin C-7 | Composite resin C-8 | Composite resin C-9 | Composite resin C-10 |
|---|---|---|---|---|---|
| Vinyl resin amount [part by mass] | 11 | 11 | 11 | 11 | 11 |
| Tg [° C.] | 61.4 | 60.4 | 61.4 | 59.3 | 57.6 |
| Tm [° C.] | 102.3 | 100.3 | 100.6 | 101.0 | 106.2 |
| Mn | 1390 | 1312 | 1324 | 1303 | 1250 |
| Mw | 15200 | 13580 | 14400 | 14200 | 13510 |
| Mw/Mn | 10.9 | 10.4 | 10.9 | 10.9 | 10.8 |
| Acid value [mgKOH/g] | 18.3 | 7.5 | 15.3 | 9.6 | 17.3 |
| Hydroxyl value [mgKOH/g] | 22.4 | 21.3 | 24.2 | 23.9 | 19.2 |

TABLE 6

| | Composite resin C-11 | Composite resin C-12 | Composite resin C-13 | Composite resin C-14 | Composite resin C-15 |
|---|---|---|---|---|---|
| Vinyl resin amount [part by mass] | 9 | 11 | 11 | 11 | 11 |
| Tg [° C.] | 56.3 | 61.2 | 57.3 | 58.2 | 58.2 |
| Tm [° C.] | 100.6 | 100.9 | 101.9 | 102.8 | 102.9 |
| Mn | 1320 | 1320 | 1297 | 1360 | 1400 |
| Mw | 14250 | 13900 | 13280 | 15090 | 14510 |
| Mw/Mn | 10.8 | 10.5 | 10.2 | 11.1 | 10.4 |
| Acid value [mgKOH/g] | 22.3 | 16.3 | 11.2 | 24.3 | 18.2 |
| Hydroxyl value [mgKOH/g] | 15.6 | 22.1 | 24.9 | 20.3 | 23.6 |

TABLE 7

| | Composite resin C-16 | Composite resin C-17 | Composite resin C-18 | Composite resin C-19 | Polyester resin P-1 |
|---|---|---|---|---|---|
| Vinyl resin amount [part by mass] | 11 | 11 | 11 | 11 | — |
| Tg [° C.] | 58.9 | 59.6 | 57.8 | 57.6 | 52.9 |
| Tm [° C.] | 105.2 | 104.3 | 100.3 | 98.2 | 100.8 |
| Mn | 1372 | 1350 | 1290 | 1250 | 1327 |
| Mw | 13670 | 16300 | 13720 | 13050 | 13100 |
| Mw/Mn | 10.0 | 12.1 | 10.6 | 10.4 | 9.9 |
| Acid value [mgKOH/g] | 15.9 | 25.3 | 5.4 | 6.9 | 9.6 |
| Hydroxyl value [mgKOH/g] | 13.2 | 22.1 | 20.3 | 23.6 | 23.6 |

<Toner Production>

The following describes respective methods for producing toners TA-1 to TA-20 and TB-1 to TB-4.

[Production of Toner TA-1]

(Toner Mother Particle Preparation)

An FM mixer ("FM-20B", product of Nippon Coke & Engineering Co., Ltd.) was charged with 100 parts by mass of the composite resin C-1, 90 parts by mass of a powder of magnetite particles ("MTS-106", product of TODA KOGYO CORP.) as a magnetic powder, 10 parts by mass of a positively chargeable charge control agent ("ACRYBASE (registered Japanese trademark) FCA-201-PS", product of Fujikura Kasei Co., Ltd., component: resin having quaternary ammonium cationic group), and 4 parts by mass of a carnauva wax (product of TOA KASEI CO., LTD.) as a releasing agent. Next, the charged toner materials were mixed for 4 minutes using the FM mixer at a rotational speed of 200 rpm.

The resultant mixture was then melt-kneaded using a twin screw extruder ("TEM-26SS", product of Toshiba Machine Co., Ltd.) under conditions of a material feeding speed of 50 g/minute, a shaft rotational speed of 100 rpm, and a cylinder temperature of 100° C. Thereafter, the resultant melt-knead product was cooled. Subsequently, the cooled melt-kneaded product was charged into a jet mill ("MJT-1", product of Hosokawa Micron Corporation) and then classified while being pulverized. As a result, toner mother particles with a volume median diameter (D50) of 8 μm were obtained.

(External Additive Addition)

Next, 100 parts by mass of the toner mother particles obtained by the above-described method, 0.6 parts by mass of silica particles ("AEROSIL (registered Japanese trademark) RA200", product of Nippon Aerosil Co., Ltd., dry silica particles rendered hydrophobic and positively chargeable through surface treatment, surface treatment agent: hexamethyldisilazane (HMDS) and aminosilane), and 0.8 parts by mass of titanium oxide particles ("EC-100", product of Titan Kogyo, Ltd., titanium oxide particles rendered conductive) were mixed for 5 minutes using an FM mixer ("FM-10B", product of Nippon Coke & Engineering Co., Ltd.) under conditions of a rotational speed of 3500 rpm and a jacket temperature of 20° C. Through the above, the entire amount of an external additive (including the silica particles and the titanium oxide particles) was attached to the surfaces of the toner mother particles.

Next, the resultant powder was sifted using a 100-mesh sieve (opening 149 μm), thereby obtaining a toner TA-1 being a positively chargeable magnetic toner. Note that the composition ratio of the components constituting the toner did not change between before and after the shifting.

[Production of Toners TA-2 to TA-20 and TB-1 to TB-4]

Toners TA-2 to TA-20 and TB-1 to TB-4 being positively chargeable magnetic toners were produced according to the same method as that for producing the toner TA-1 in all aspects other than that the type of the binder resin charged into the FM mixer and the type and amount of the magnetic powder charged into the FM mixer in the toner mother particle preparation were changed to those as shown in Table 8. Note that "MTS-106", "MTS-D3", and "MRO-15A" in Table 8 are tradenames of magnetic powders (powders of magnetite particles) produced by TODA KOGYO CORP. Also, "Amount" under the column titled "Magnetic powder" in Table 8 refers to an amount of charge (unit: part by mass) of a corresponding magnetic powder relative to 100 parts by mass of a corresponding binder resin.

TABLE 8

| Toner | Type of binder resin | Magnetic powder Type | Magnetic powder Amount [part by mass] |
|---|---|---|---|
| TA-1 | Composite resin C-1 | MTS-106 | 90 |
| TA-2 | Composite resin C-2 | MTS-106 | 90 |
| TA-3 | Composite resin C-3 | MTS-106 | 90 |
| TA-4 | Composite resin C-4 | MTS-106 | 90 |
| TA-5 | Composite resin C-5 | MTS-106 | 90 |
| TA-6 | Composite resin C-6 | MTS-106 | 90 |
| TA-7 | Composite resin C-7 | MTS-106 | 90 |
| TA-8 | Composite resin C-8 | MTS-106 | 90 |
| TA-9 | Composite resin C-9 | MTS-106 | 90 |
| TA-10 | Composite resin C-10 | MTS-106 | 90 |
| TA-11 | Composite resin C-11 | MTS-106 | 90 |
| TA-12 | Composite resin C-12 | MTS-106 | 90 |
| TA-13 | Composite resin C-13 | MTS-106 | 90 |
| TA-14 | Composite resin C-14 | MTS-106 | 90 |
| TA-15 | Composite resin C-15 | MTS-106 | 90 |
| TA-16 | Composite resin C-16 | MTS-106 | 90 |
| TA-17 | Composite resin C-1 | MTS-106 | 70 |
| TA-18 | Composite resin C-1 | MTS-106 | 110 |
| TA-19 | Composite resin C-1 | MTS-D3 | 90 |
| TA-20 | Composite resin C-1 | MRO-15A | 90 |
| TB-1 | Composite resin C-17 | MTS-106 | 90 |
| TB-2 | Composite resin C-18 | MTS-106 | 90 |
| TB-3 | Composite resin C-19 | MTS-106 | 90 |
| TB-4 | Polyester resin P-1 | MTS-106 | 90 |

<Methods for Measuring Wabs and Wps>

With respect to each of the toners TA-1 to TA-20 and TB-1 to TB-4 obtained by the above methods, Wabs and Wps of the binder resin were measured. A measuring device used was a molecular weight measurement device equipped with a liquid feed pump ("LC-20AD", product of Shimadzu Corporation), first columns ("TSKgel GMHXL", product of Tosoh Corporation, column size: inner diameter 7.8×length 30 cm, number of columns: 2), a second column ("TSKgel G2500HXL", product of Tosoh Corporation, column size: inner diameter 7.8 mm×length 30 cm, number of columns: 1), a differential refractive index detector ("OPTILAB T-rEX", product of Wyatt Technology Corporation, wavelength: $6.58\times10^{-5}$ cm, correction constant: $3.4939\times10^{-5}$ RIU/pixel), and a multi-angle light scattering detector ("DAWN HELEOS II", product of Wyatt Technology Corporation, wavelength: $6.63\times10^{-5}$ cm, correction constant: $2.9939\times10^{-5}$ $V^{-1}\cdot cm^{-1}$). Details of the measuring methods were as follows. First, 5 mL of tetrahydrofuran and 10 mg of the toner (any of the toners TA-1 to TA-20 and TB-1 to TB-4) being a measurement target were added into a beaker. Next, the beaker contents were stirred in a 25° C. atmosphere, and then filtered using a filter with an opening of 0.2 μm, thereby obtaining a tetrahydrofuran solution of a binder resin (specifically, a binder resin dissolved in tetrahydrofuran at a temperature of 25° C.) as a measurement sample.

Subsequently, an absolute molecular weight distribution curve (differential molecular weight distribution curve) by the SEC-MALLS method and a relative molecular weight distribution curve (differential molecular weight distribution curve) in terms of polystyrene by the SEC-RI method were plotted for the resultant measurement sample under the following measurement conditions. Then, an absolute molecular weight (Wabs) at a largest peak on the plotted absolute molecular weight distribution curve and a relative molecular weight (Wps) at a largest peak on the plotted relative molecular weight distribution curve were determined. Note that the absolute molecular weight was calculated out from an intercept on a Zimm plot plotted using measurement data processed using "GPC data processing system" produced by Toray Research Center, Inc. with a sample concentration (a concentration of the binder resin dissolved in a mobile phase solvent) taken to be 0 g/mL. Furthermore, output values of the multi-angle light scattering detector at specific detector angles (specifically, 45.8°, 53.8°, 61.6°, 70.4°, 80.2°, and 90.0°) were used in plotting the absolute molecular weight distribution curve by the SEC-MALLS method. A calibration curve in calculating the relative molecular weight in terms of polystyrene was plotted using monodispersed polystyrene standard samples produced by Tosoh Corporation (mass average molecular weight of polystyrene: $3.84\times10^6$, $1.09\times10^6$, $7.06\times10^5$, $4.27\times10^5$, $1.90\times10^5$, $9.64\times10^4$, $3.79\times10^4$, $1.62\times10^4$, $1.02\times10^4$, $5.06\times10^3$, $2.63\times10^3$, $1.01\times10^3$, and $5.90\times10^2$).

[Measurement Conditions]

Mobile phase solvent: Tetrahydrofuran

Flow rate of mobile phase solvent: 1.0 mL/minute

Column temperature: 23° C.

Detector temperature: 25° C.

Concentration of binder resin in measurement sample: 2 mg/mL

Charge amount: 0.200 mL

Concentration of binder resin (binder resin dissolved in mobile phase solvent) at each peak on distribution curve: Calculated from the concentration of the binder resin in the measurement sample, the flow rate of the mobile phase solvent, the charge amount, and output values of standard samples with known concentrations (specifically, binder resin solutions with known concentrations dissolved in tetrahydrofuran at a temperature of 25° C.) measured in advance using the aforementioned differential refractive index detector Concentration gradient (dn/dc) of refractive index: Calculated from the gradient of a graph showing a relationship between concentration c of the binder resin and refractive index n of tetrahydrofuran measured in advance using an Abbe's refractometer ("KPR-30A", product of Shimadzu Corporation).

Optical constant K (unit: $cm^6/g^2$) in plotting Zimm plot: Calculated from do/dc, the wavelength of the aforementioned multi-angle light scattering detector, and Avogadro's number ($Na=6.02\times10^{23}$).

Table 9 shows Wps, Wabs, and Wabs/Wps for each of the toners TA-1 to TA-20 and TB-1 to TB-4.

TABLE 9

| Toner | Wps | Wabs | Wabs/Wps |
|---|---|---|---|
| TA-1 | 7299 | 11905 | 1.63 |
| TA-2 | 8269 | 15049 | 1.82 |

TABLE 9-continued

| Toner | Wps | Wabs | Wabs/Wps |
|---|---|---|---|
| TA-3 | 7102 | 10511 | 1.48 |
| TA-4 | 8126 | 12432 | 1.53 |
| TA-5 | 7690 | 11060 | 1.44 |
| TA-6 | 8230 | 15200 | 1.85 |
| TA-7 | 7507 | 10163 | 1.35 |
| TA-8 | 7560 | 14250 | 1.88 |
| TA-9 | 8630 | 11500 | 1.33 |
| TA-10 | 8940 | 13600 | 1.52 |
| TA-11 | 8520 | 12630 | 1.48 |
| TA-12 | 7680 | 13690 | 1.78 |
| TA-13 | 8547 | 14360 | 1.68 |
| TA-14 | 8025 | 12260 | 1.53 |
| TA-15 | 7860 | 12630 | 1.61 |
| TA-16 | 6620 | 11630 | 1.76 |
| TA-17 | 8263 | 13620 | 1.65 |
| TA-18 | 6920 | 10960 | 1.58 |
| TA-19 | 7250 | 12020 | 1.66 |
| TA-20 | 7299 | 12030 | 1.65 |
| TB-1 | 7050 | 15280 | 2.17 |
| TB-2 | 7420 | 8950 | 1.21 |
| TB-3 | 7299 | 10980 | 1.50 |
| TB-4 | 7299 | 10320 | 1.41 |

<Evaluation Methods>

The following describes methods for evaluating each of the toners TA-1 to TA-20 and TB-1 to TB-4.

[Image Density]

An evaluation apparatus used was a monochrome printer (ECOSYS (registered Japanese trademark) LS-4200DN", product of KYOCERA Document Solutions Inc.). The toner (measurement target: any of the toners TA-1 to TA-20 and TB-1 to TB-4) was loaded into a development device and a toner container of the evaluation apparatus. Next, a solid image with a size of 25 mm by 25 mm was printed on a sheet of printing paper (A4-size plain paper, basis weight: 90 $g/m^2$) using the evaluation apparatus under environmental conditions of a temperature of 23° C. and a relative humidity of 50%. The image density (ID) of the printed solid image was then measured using a reflectance densitometer ("RD914", product of X-Rite Inc.). The toner was evaluated as "good" if the measured image density (ID) was at least 1.10 and evaluated as "poor" if the measured image density (ID) was less than 1.10.

[Minimum Fixable Temperature]

An evaluation apparatus used was an image forming apparatus that was a monochrome printer ("ECOSYS (registered Japanese trademark) LS-4200DN", product of KYOCERA Document Solutions Inc.) modified to be changeable in fixing temperature.

The toner (evaluation target: any of the toners TA-1 to TA-20 and TB-1 to TB-4) was loaded into a development device and a toner container of the evaluation apparatus. Next, a solid image with a size of 25 mm by 25 mm (specifically, an unfixed toner image not having passed through a fixing device) was formed on printing paper with a basis weight of 90 $g/m^2$ (A4-size plain paper) using the evaluation apparatus under environmental conditions of a temperature of 23° C. and a relative humidity of 50%.

Subsequently, the printing paper with the solid image formed thereon was made to pass through the fixing device of the evaluation apparatus. At that time, while the fixing temperature of the fixing device was increased from 170° C. in increments of 1° C., fixability at each fixing temperature was determined to measure the lowest temperature (minimum fixable temperature) at which the solid image (toner image) was fixed to the printing paper.

Whether or not the toner was fixed was confirmed by the following rubbing test. Specifically, the image density of the solid image on the printing paper having passed through the fixing device (also referred to below as pre-rubbing ID) was measured using a reflectance densitometer ("RD914", product of X-Rite Inc.). Subsequently, using a 1-kg weight covered with fabric, the image on the printing paper was rubbed back and forth 10 times so that only the weight of the weight was applied to the printing paper. Then, the image density of the solid image on the printing paper (hereinafter referred to as "post-rubbing ID") was measured using the reflectance densitometer ("RD914", product of X-Rite Inc.). Next, the fixing rate (unit: %) was calculated using an expression "(fixing rate)=100×(post-rubbing ID)/(pre-rubbing ID)". The lowest temperature among the fixing temperatures at which the fixing rate was 95% or higher was taken to be a minimum fixable temperature. The toner was evaluated as "low-temperature fixability being ensured" if the minimum fixable temperature was 200° C. or lower, and evaluated as "low-temperature fixability being not ensured" if the minimum fixable temperature exceeded 200° C.

[Maximum Fixable Temperature]

An evaluation apparatus used was an image forming apparatus that was a monochrome printer ("ECOSYS (registered Japanese trademark) LS-4200DN", product of KYOCERA Document Solutions Inc.) modified to be changeable in fixing temperature. The toner (measurement target: any of the toners TA-1 to TA-20 and TB-1 to TB-4) was loaded into a development device and a toner container of the evaluation apparatus. Next, a solid image with a size of 25 mm by 25 mm (specifically, an unfixed toner image not having passed through a fixing device) was formed on printing paper with a basis weight of 90 g/m$^2$ (A4-size plain paper) using the evaluation apparatus set in a half speed mode as an image formation condition under environmental conditions of a temperature of 23° C. and a relative humidity of 50%. Subsequently, the printing paper with the solid image formed thereon was made to pass through the fixing device of the evaluation apparatus. At that time, while the fixing temperature of the fixing device was increased from 190° C. in increments of 1° C., occurrence or non-occurrence of hot offset was visually checked at each fixing temperature to determine the highest temperature (maximum fixable temperature) at which hot offset did not occur. The occurrence or non-occurrence of hot offset was determined according to whether or not any spots resulting from adhesion of toner to a fixing roller (spots appearing at every rotation of a fixing roller) was observed on the printing paper.

The toner was evaluated as "being excellent in hot offset resistance" if the maximum fixable temperature was 210° C. or higher, and evaluated as "being not excellent in hot offset resistance" if the maximum fixable temperature was lower than 210° C.

[Fixing Strength]

An evaluation apparatus used was an image forming apparatus that was a monochrome printer ("ECOSYS (registered Japanese trademark) LS-4200DN", product of KYOCERA Document Solutions Inc.) modified to be changeable in fixing temperature. The toner (evaluation target: any of the toners TA-1 to TA-20 and TB-1 to TB-4) was loaded into a development device and a toner container of the evaluation apparatus. Next, a solid image with a size of 25 mm by 25 mm (specifically, an unfixed toner image not having passed through a fixing device) was formed on a sheet of printing paper (A4-size plain paper, basis weight: 90 g/m$^2$) using the evaluation apparatus under environmental conditions of a temperature of 23° C. and a relative humidity of 50%. Subsequently, the printing paper with the solid image formed thereon was made to pass through the fixing device of the evaluation apparatus. At that time, while the fixing temperature of the fixing device was set to the minimum fixable temperature measured by the measuring method described above in [Minimum Fixable Temperature]. However, the fixing temperature of the fixing device was set to 220° C. in evaluation for the toner TB-3.

Subsequently, mending tape ("No. 810-3-12", product of 3M Japan Limited) was applied to the fixed solid image, and the solid image was rubbed back and forth 5 times with a pressure of 30 gf/cm$^2$ over the mending tape. Then, the mending tape was peeled off from the solid image with a force of 100 gf at a peel angle of 90°, and the solid image on the printing paper was visually observed for determination in accordance with the following criteria. The toner was evaluated as "image with excellent fixing strength being formed" if the determination result met a criterion A and that "image with not so excellent fixing strength being formed" if the determination result met a criterion B.

(Determination Criteria for Fixing Strength)

A: The solid image was not peeled off.

B: At least a part of the solid image was peeled off.

<Evaluation Result>

Table 10 shows image density, minimum fixable temperature, maximum fixable temperature, and determination results of fixing strength for each of the toners TA-1 to TA-20 and TB-1 to TB-4.

Table 10

| | Toner | Image density | Minimum fixable temperature | Maximum fixable temperature | Determination result of fixing strength |
|---|---|---|---|---|---|
| Example 1 | TA-1 | 1.21 | 185° C. | 240° C. | A |
| Example 2 | TA-2 | 1.23 | 200° C. | 245° C. | A |
| Example 3 | TA-3 | 1.20 | 185° C. | 210° C. | A |
| Example 4 | TA-4 | 1.23 | 195° C. | 230° C. | A |
| Example 5 | TA-5 | 1.22 | 185° C. | 210° C. | A |
| Example 6 | TA-6 | 1.22 | 200° C. | 240° C. | A |
| Example 7 | TA-7 | 1.18 | 185° C. | 210° C. | A |
| Example 8 | TA-8 | 1.22 | 195° C. | 235° C. | A |
| Example 9 | TA-9 | 1.18 | 185° C. | 210° C. | A |
| Example 10 | TA-10 | 1.18 | 200° C. | 230° C. | A |
| Example 11 | TA-11 | 1.20 | 195° C. | 235° C. | A |
| Example 12 | TA-12 | 1.21 | 195° C. | 240° C. | A |
| Example 13 | TA-13 | 1.18 | 200° C. | 245° C. | A |
| Example 14 | TA-14 | 1.19 | 185° C. | 225° C. | A |
| Example 15 | TA-15 | 1.21 | 195° C. | 240° C. | A |
| Example 16 | TA-16 | 1.20 | 200° C. | 245° C. | A |
| Example 17 | TA-17 | 1.18 | 185° C. | 240° C. | A |
| Example 18 | TA-18 | 1.22 | 200° C. | 240° C. | A |
| Example 19 | TA-19 | 1.20 | 190° C. | 240° C. | A |
| Example 20 | TA-20 | 1.19 | 185° C. | 240° C. | A |
| Comparative Example 1 | TB-1 | 1.21 | 220° C. | 240° C. | A |
| Comparative Example 2 | TB-2 | 1.21 | 185° C. | 195° C. | A |
| Comparative Example 3 | TB-3 | 1.23 | >220° C. | <190° C. | B |
| Comparative Example 4 | TB-4 | 1.22 | 185° C. | 195° C. | A |

Each of the toners TA-1 to TA-20 contained a binder resin including a polyester resin and a vinyl resin. In each of the toners TA-1 to TA-20, the vinyl resin included in the binder resin included a repeating unit derived from the specific vinyl compound.

As shown in Table 9, the toners TA-1 to TA-20 each had a Wabs/Wps of at least 1.30 and no greater than 2.00.

As shown in Table 10, the toners TA-1 to TA-20 each had a minimum fixable temperature of 200° C. or lower. As such, the toners TA-1 to TA-20 ensured low-temperature fixability. The toners TA-1 to TA-20 each had a maximum fixable temperature of 210° C. or higher. As such, the toners TA-1 to TA-20 were excellent in hot offset resistance. The determination results of fixing strength for the images printed using the respective toners TA-1 to TA-20 met the criterion A. As such, images with excellent fixing strength were formed with the respective toners TA-1 to TA-20.

As shown in Table 9, the toner TB-1 had a Wabs/Wps of greater than 2.00. The toner TB-2 had a Wabs/Wps of less than 1.30.

The toner TB-3 contained a binder resin including a polyester resin and a vinyl resin. However, in the toner TB-3, the vinyl resin included in the binder resin did not include a repeating unit derived from the specific vinyl compound. The binder resin contained in the toner TB-4 did not include a vinyl resin.

As shown in Table 10, the toners TB-1 and TB-3 each had a minimum fixable temperature of higher than 200° C. As such, the toners TB-1 and TB-3 did not ensure low-temperature fixability. The toners TB-2 and TB-4 each had a maximum fixable temperature of lower than 210° C. As such, the toners TB-2 and TB-4 were not excellent in hot offset resistance. The determination result of fixing strength for the image printed using the toner TB-3 met the criterion B. As such, an image with excellent fixing strength was not formed with the toner TB-3.

The above results demonstrated that the present disclosure can provide a toner excellent in hot offset resistance with which images with excellent fixing strength can be formed while ensuring low-temperature fixability.

What is claimed is:

1. A toner comprising toner particles, wherein the toner particles each include a toner mother particle containing a binder resin and a releasing agent, the binder resin includes a polyester resin and a vinyl resin, the vinyl resin includes one or more repeating units selected from the group consisting of a repeating unit derived from acrylic acid, a repeating unit derived from methacrylic acid, and a repeating unit represented by general formula (1) shown below, a relationship $1.30 \leq Wabs/Wps \leq 2.00$ is satisfied where Wabs represents an absolute molecular weight at a largest peak on an absolute molecular weight distribution curve of the binder resin as measured by size-exclusion chromatography using a multi-angle laser light scattering detector, and Wps represents a relative molecular weight at a largest peak on a relative molecular weight distribution curve of the binder resin in terms of polystyrene as measured by size-exclusion chromatography using a differential refractive index detector, a total content ratio of the polyester resin and the vinyl resin in the toner mother particles to a total amount of the binder resin is 100% by mass, and an amount of the vinyl resin is at least 5 parts by mass and no greater than 15 parts by mass relative to 100 parts by mass of the polyester resin, (2)

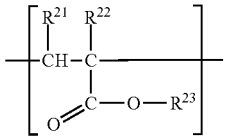

where in the general formula (1), $R^{11}$ and $R^{12}$ each represent, independently of one another, a hydrogen atom, a halogen atom, or an alkyl group having a carbon number of at least 1 and no greater than 6, and $R^{13}$ represents an alkylene group having a carbon number of at least 1 and no greater than 6.

2. The toner according to claim 1, wherein the polyester resin includes one or more repeating units selected from the group consisting of repeating units derived from tri- or higher-hydric alcohol compounds and repeating units derived from tri- or higher-basic carboxylic acids.

3. The toner according to claim 2, wherein the polyester resin includes a repeating unit derived from glycerol or a repeating unit derived from trimellitic acid.

4. The toner according to claim 1, wherein the repeating unit represented by the general formula (1) is a repeating unit derived from 2-hydroxyethyl methacrylate.

5. The toner according to claim 1, wherein the vinyl resin includes one or more repeating units selected from the group consisting of a repeating unit derived from styrene, a repeating unit derived from acrylonitrile, and a repeating unit represented by general formula (2) shown below, (2)

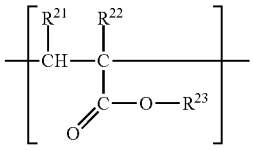

where in the general formula (2), $R^{21}$ and $R^{22}$ each represent, independently of one another, a hydrogen atom, a halogen atom, or an alkyl group having a carbon number of at least 1 and no greater than 6, and $R^{23}$ represents an alkyl group having a carbon number of at least 1 and no greater than 6.

6. The toner according to claim 5, wherein the repeating unit represented by the general formula (2) is a repeating unit derived from methyl methacrylate.

7. The toner according to claim 1, wherein the toner mother particle further contains a magnetic powder.

8. The toner according to claim 1, wherein the vinyl resin includes the repeating unit represented by the general formula (1).

* * * * *